US008749600B2

(12) United States Patent
Rannow et al.

(10) Patent No.: US 8,749,600 B2
(45) Date of Patent: Jun. 10, 2014

(54) METHODS AND DEVICES FOR ELECTROPHOTOGRAPHIC PRINTING

(75) Inventors: Randy K. Rannow, Albany, OR (US); Tom Camis, Boise, ID (US); James W. Stasiak, Lebanon, OR (US); Robert J. Lawton, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2438 days.

(21) Appl. No.: 11/589,615

(22) Filed: Oct. 30, 2006
(Under 37 CFR 1.47)

(65) Prior Publication Data

US 2008/0143808 A1 Jun. 19, 2008

(51) Int. Cl.
*B41J 2/385* (2006.01)
*B41J 2/415* (2006.01)

(52) U.S. Cl.
USPC ..... 347/111; 347/140; 347/122

(58) Field of Classification Search
USPC ..... 347/140, 111, 122
See application file for complete search history.

(56) References Cited

U.S. PATENT DOCUMENTS 3,746,442 A * 7/1973 Davidson ..... 399/191
5,225,880 A 7/1993 Shehata et al.
5,596,356 A 1/1997 Lee
5,680,167 A 10/1997 Willis
5,693,441 A 12/1997 Gibson et al.
5,703,487 A 12/1997 Mishra
5,713,062 A 1/1998 Goodman et al.
5,781,828 A 7/1998 Caruthers, Jr. et al.
5,848,322 A 12/1998 Chen et al.
5,848,337 A 12/1998 Liu et al.
5,864,734 A * 1/1999 Lewis et al. ..... 399/99
5,897,239 A 4/1999 Caruthers, Jr. et al.
5,899,605 A 5/1999 Caruthers, Jr. et al.

(Continued)

FOREIGN PATENT DOCUMENTS

EP 0 964 310 B1 12/1999
EP 1598709 11/2005

(Continued)

OTHER PUBLICATIONS

International Search Report for PCT/US2007/082874, Based on US Priority [U.S. Appl. No. 11/589,685]. Report Issued Mar. 27, 2008.

*Primary Examiner* — Sarah Al Hashimi

(57) ABSTRACT

A printing device includes a developer for developing a latent image with toner particles; an imaging plate comprising a plurality of pixel plates; and a plurality of voltage generators connected respectively to the pixel plates. The voltage generators positively bias selected pixel plates to form a latent image that is developed with toner from the developer.

Another printing device includes a developer for developing a latent image with toner particles; an imaging plate comprising a plurality of pixel plates for selectively receiving toner particles from the developer; a plurality of voltage generators for biasing respective to pixel plates; and a background grid in the imaging plate for preventing toner particles from being deposited in areas between the pixel plates, wherein the background grid is connected to a voltage generator for applying a range of biases, positive and negative to the background grid.

A method of electrophotographic printing in which toner particles are moved electrostatically from a developer to develop a latent image includes positively biasing selected pixel plates of a plurality of pixel plates of an imaging plate to form the latent image; and developing the latent image with the toner particles from the developer.

28 Claims, 7 Drawing Sheets

(56) References Cited

U.S. PATENT DOCUMENTS

| | | | | |
|---|---|---|---|---|
| 5,914,744 | A | 6/1999 | Ng | |
| 6,002,893 | A | 12/1999 | Caruthers, Jr. et al. | |
| 6,167,210 | A | 12/2000 | Maess et al. | |
| 6,321,043 | B1 | 11/2001 | Grace | |
| 6,970,673 | B2 | 11/2005 | Amarakoon | |
| 2002/0158956 | A1 * | 10/2002 | Van Der Meer et al. | 347/141 |
| 2004/0253014 | A1 | 12/2004 | Bares | |
| 2005/0089348 | A1 | 4/2005 | Amarakoon | |
| 2005/0214039 | A1 | 9/2005 | Marsh et al. | |
| 2005/0214040 | A1 | 9/2005 | Marsh et al. | |

FOREIGN PATENT DOCUMENTS

| | | |
|---|---|---|
| GB | 014118292 | 12/1975 |
| JP | 2000211175 | 8/2000 |
| WO | WO 2005096103 A1 | 10/2005 |

* cited by examiner

METHODS AND DEVICES FOR ELECTROPHOTOGRAPHIC PRINTING

BACKGROUND

The electrophotographic process is a widely used printing technology for generating hardcopy documents from electronic data. At the heart of the electrophotographic imaging process is an organic photoconductive (OPC) drum. This drum typically includes an extruded aluminum cylinder coated with a non-toxic organic photoconductive material. A light source, such as a laser or a light emitting diode, is used to create a latent image by selectively discharging portions of a uniform charge field conditioned on the photoconductive material of the drum. There are six generalized stages to the electrophotography process: cleaning, conditioning, writing, developing, transferring and fixing. More details of the basic electrophotographic process will be described below.

The cleaning stage prepares the OPC drum to receive a new latent image by applying a physical and electrical cleaning process. The physical cleaning of the OPC is typically accomplished by a drum-cleaning blade (or wiper blade) and a recovery blade. The wiper blade scrapes any excess toner from the drum and the recovery blade catches the toner and sweeps it into a waste hopper. In the electrical aspect of cleaning, the previous charge field on the drum must be cleared before a new one may be applied. The electrical cleaning of the OPC drum is performed by erasure lamps (usually corona wire technology) or a primary charge roller (PCR), which eliminate the previous charge field and latent image from the drum.

After the drum has been cleaned, it must be conditioned or charged to accept the next image from the light source. A primary corotron (corona wire or PCR) applies a uniform negative charge (usually in the range of −600V to −720 V DC) to the surface of the drum.

Following the conditioning stage is the writing stage. According to this stage, the light source, e.g., a laser beam, is used to selectively discharge portions of the conditioned charge field from the drum surface. This selective discharge of the conditioned charge field creates a latent image on the drum. This is achieved as follows. The metal base of the OPC drum is connected to an electrical ground. The photoconductive material on the OPC becomes electrically conductive when exposed to light. Therefore, the negative charges deposited onto the surface of the drum conduct to the metal base and thence to ground when the photoconductive material is exposed to light, thereby creating the latent image. The latent image area will attract toner in a later stage.

The fourth stage is developing. At this stage, the latent image becomes a visible image. This stage generally requires four major components: toner, a developer roller assembly, a metering blade, and an AC/DC charge. Toner is attracted to the developer roller either by an internal magnet or by an electrostatic charge. The roller carries the toner particles to a metering or doctor blade, where toner tumbles and creates a tribo-electric charge (friction) on the surface of the toner particles. The metering blade then provides for an evenly distributed amount of toner to pass to the OPC drum. Once the toner particle has passed beyond the doctor blade, it is ready to be presented to the OPC drum. The developer roller is then charged with an AC/DC charge from the High Voltage Power Supply. This charge allows the toner particles to "jump" from the developer roller and travel to the OPC drum where it is attracted to the latent image.

At this point, the toner image on the drum is transferred onto a sheet of paper. As the paper is passed under the OPC drum, it is passing over a transfer corotron assembly. The transfer corotron assembly places a positive charge on the back of the page, thus attracting the toner from the drum.

The sixth and final stage is fixing. Also known as fusing, this is the stage in which toner is permanently affixed to the paper. The fuser assembly typically includes a heated roller, a pressure roller, a heating element, a thermistor, a thermal fuse, and, sometimes, a cleaning pad. The heating element is typically placed inside the heated roller, which is usually constructed of aluminum with a Teflon coating. The roller is heated to approximately 355° F. (180° C.). The second roller is usually a rigid foamed silicon rubber. This second roller applies pressure to the heated roller. The paper passes between the two rollers and the heated roller melts the toner particles while the pressure roller presses the toner into the fiber weave of the paper.

SUMMARY

A printing device includes a developer for developing a latent image with toner particles; an imaging plate comprising a plurality of pixel plates; and a plurality of voltage generators connected respectively to the pixel plates. The voltage generators positively bias selected pixel plates to form a latent image that is developed with toner from the developer. Another printing device includes a developer for developing a latent image with toner particles; an imaging plate comprising a plurality of pixel plates for selectively receiving toner particles from the developer; a plurality of voltage generators for biasing respective to pixel plates; and a background grid in the imaging plate to prevent toner particles from being deposited in areas between the pixel plates, wherein the background grid is connected to a voltage generator for applying a range of biases, positive and negative to the background grid. A method of electrophotographic printing in which toner particles are moved electrostatically from a developer to develop a latent image includes positively biasing selected pixel plates of a plurality of pixel plates of an imaging plate to form the latent image; and developing the latent image with the toner particles from the developer.

BRIEF DESCRIPTION OF THE DRAWINGS

The accompanying drawings illustrate various embodiments of the present invention and are a part of the specification. The illustrated embodiments are merely examples of the present invention and do not limit the scope of the claims.

Throughout the drawings, identical reference numbers designate similar, but not necessarily identical, elements.

DETAILED DESCRIPTION

As indicated above, electrophotography is a well-known technology with broad applications in the printing arena. Printers based on the use of a laser or light emitting diode (LED) to create a latent image are the most common schemes of electrophotographic printers. However, these devices have some print quality limitations, may be relatively noisy to operate and consume significant power. Conventional electrophotographic printers may also have a negative ozone impact.

In order to improve the quality and resolution of text and images produced by electrophotography, the present specification describes new methods and devices for creating a latent image and then developing the image by electrostatically transferring toner particles. The toner particles may then be fixed to the substrate with flash fusing to eliminate curing or drying.

Figure 1:
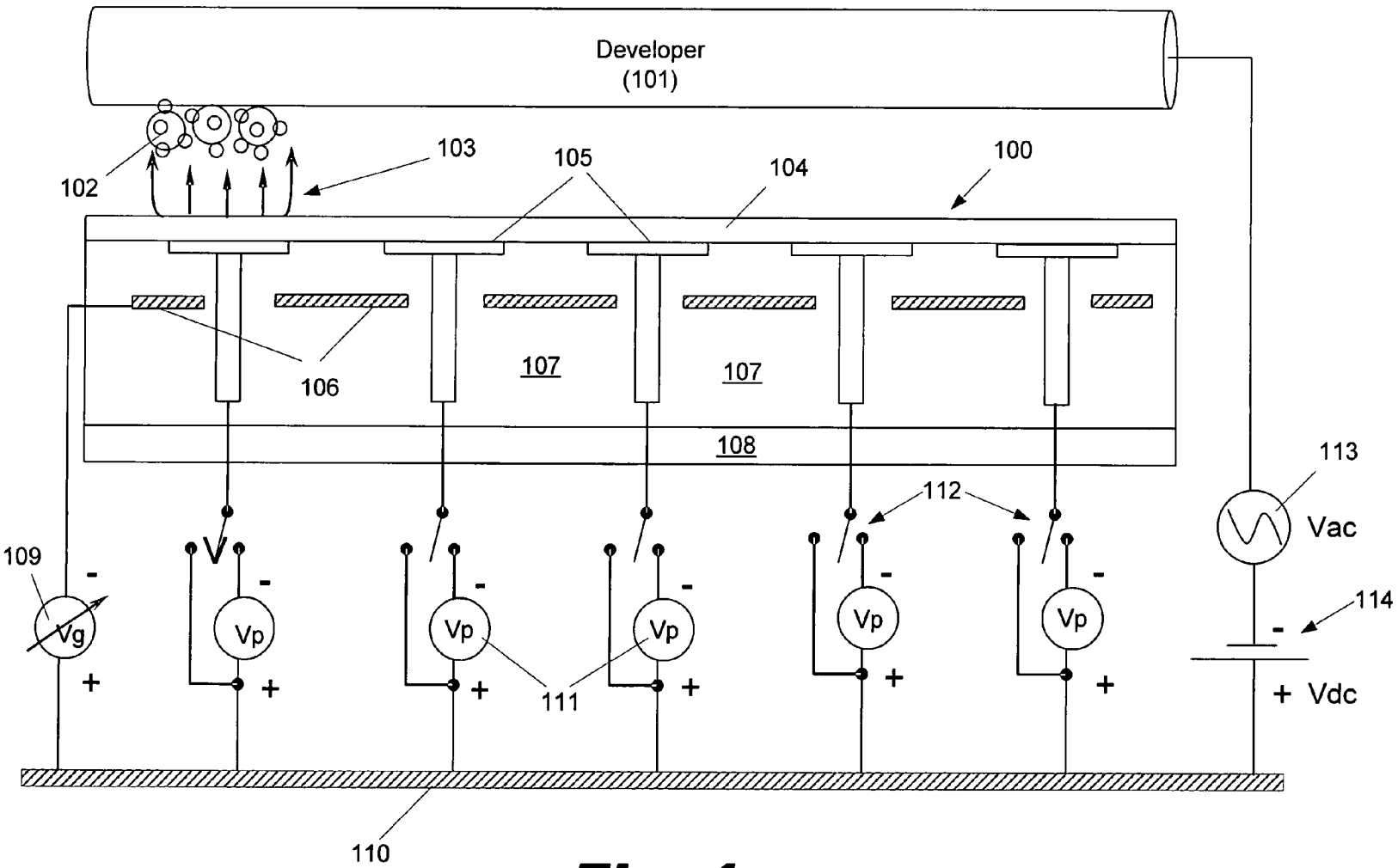
FIG. 1 illustrates an example of a printing device that uses an electrical field to selectively transfer charged toner particles from a developer to develop a latent image formed on an imaging plate according to principles described herein.

FIG. 1 illustrates an example of a printing device that uses an electrical field ("E-field") to selectively transfer charged toner particles from a developer to develop a latent image formed on an imaging plate. The technique used in the device of FIG. 1 will be referred to as Discharge Area Development ("DAD") printing.

As shown in FIG. 1, a charged developer (101) is covered with charged toner particles (102) for developing a latent image. The developer (101) may be a roller or a plate as best serves a particular application. The developer (101) is connected to a ground plate (110) through a direct current voltage source (114) and a voltage oscillator (113). The toner particles (102) are negatively charged. Consequently, the developer (101) may be given a positive charge to attract the toner particles (102) when the developer is being loaded with toner prior to a printing run. During printing, however, the developer (101) is given a negative bias that allows the toner particles (102) to be selectively transferred to an imaging plate (100).

The imaging plate (100) includes a wear layer (104) that is configured to resist wear despite contact with toner particles, print media such as paper, etc. Under the wear layer (104), a high-voltage interlayer dielectric (ILD) (107) is disposed between the wear layer (104) and a base substrate (108).

Within the insulator (107), an array of pixel plates (105) are provided. Each pixel plate (105) is located parallel to and just below the wear layer (104) of the imaging plate (100). As shown in FIG. 1, each pixel plate (105) is electrically connected through the imaging plate (100) to one of a corresponding array of voltage generators (111). As will be described in more detail below, this conductive plate of each pixel can be selectively given an electrical bias so as to electrostatically move toner (102) from the developer (101) to the imaging plate (100) to print a pixel corresponding to the charged pixel plate (105).

Each pixel plate (105) is connected to a corresponding voltage generator (111) through a switch (112). The switches (112) and other switches mentioned herein may each be implemented as a transistor. The switch or transistor (112) can selectively connect a corresponding pixel plate (105) to either the voltage generator (111) or the ground plate (110).

When an image is to be printed, the developer (101) is loaded with toner (102). Additionally, a latent image is formed on the imaging plate (100). This is done by selectively connected pixel plates (105) with corresponding voltage generators (111) in a pattern that forms the desired latent image on the imaging plate (100). Pixel plates (105) that are to receive toner are grounded with respective switches (112). Pixel plates (105) that are not to receive toner (102) are negatively charged by connecting the respective switches (112) to the respective voltage generators (111).

In order to prevent toner particles (102) from being deposited between pixel plates (105), a background grid (106) is provided in the insulator (107) of the imaging plate (100) between pixel plates (105). In the embodiment shown in FIG. 1, the background grid is located in the insulating layer (107) below, and some distance from, the plane of the pixel plates (105). Consequently, the background grid (106) is, in this case, referred to as a sub-planar grid.

The background grid (106) is electrically connected to a voltage generator (109). During printing, the background grid (106) is given a negative bias by the generator (109). The negative bias of the background grid (106) is stronger than the negative bias on the developer (101), thereby tending to prevent the transfer of negatively-charged toner particles (102) from the developer (101) to the background areas of the imaging plate (100), i.e., between pixels (105) and corresponding to the area underlain by the background grid (106).

Thus, when an image is to be printed, the developer (101) is loaded with toner (102) and a latent image is formed on the imaging plate (100) as described above. The latent image is formed by pixel plates (105) that are connected through respective switches (112) to ground and, therefore, are considered as not charged. Pixel plates (105) that do not form part of the latent image are connected through respective switches (112) to a voltage generator (111) and become negatively biased.

The developer (101) may then be passed over or brought near the imaging plate (100) depending on the particular mechanism employed. The negatively-charged toner particles (102) on the developer (101) are repelled by the negative bias given to the developer (101). Consequently, the toner particles (102) are moved electrostatically by the resulting electrical field (103) from the developer (101) to the areas of the imaging plate (100) that correspond to each grounded and unbiased pixel plate (105). The areas of the imaging plate (100) where there are negatively charged pixel plates (105) repel the toner particles (102) more strongly than the particles (102) are repelled by the developer (101), thus preventing the deposition of toner particles (102) in those areas. Additionally, toner particles (102) are repulsed from the areas between pixels (105) by the negative bias of the background grid (106), which is also stronger than the negative bias of the developer (101).

In this way, toner particles (102) are selectively deposited on the imaging plate (101) only over the selectively-grounded pixel plates and the latent image formed by these grounded pixel plates is developed. The developed image can then be transferred to a sheet of print media, such as paper, and the printing process for that image is complete.

As will be appreciated by those skilled in the art, the printing system and method described above uses a careful balance of the biasing of the developer, pixel plates and background grid in order to facilitate the desired and selective transfer of toner particles from the developer to the imaging plate so as to develop the latent image. In this regard, the bias applied to the background grid, in particular, is carefully controlled and may be adjusted as best suits a particular application.

Figure 2:
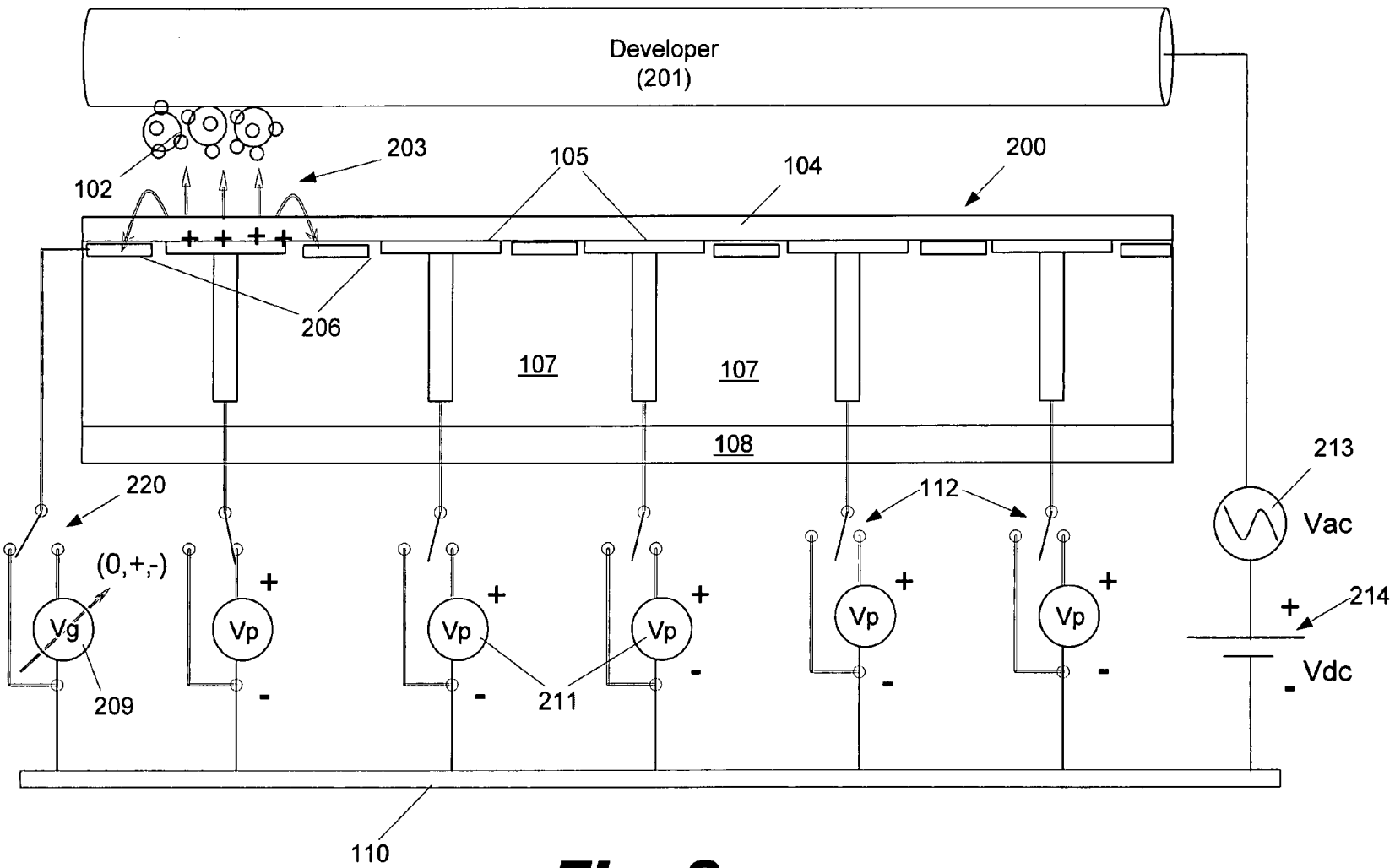
FIG. 2 illustrates another example of a printing device that uses an electrical field to selectively transfer charged toner particles from a developer to develop a latent image formed on an imaging plate according to principles described herein.

FIG. 2 illustrates another example of a printing device that uses an electrical field to selectively transfer charged toner particles from a developer to develop a latent image formed on an imaging plate. The technique used in the device of FIG. 2 will be referred to as Charge Area Development ("CAD") printing.

In DAD printing, as described above, there may be limited control over the electrical field generated between the developer and the imaging plate due to background grid control requirements and the careful balance among the biases used to move the toner particles. Such constraints on the electrical field used to transfer toner particles from the developer to the imaging plate may adversely impact possible print quality and other printing attributes.

In contrast, CAD electrographic or micro-electrographic printing or copying allows for much more control over the electrical field between the developer and imaging plate. CAD printing operates by applying a control signal (i.e., voltage) to a pixel such that the conductive metal pixel plate becomes positively charged. Alternatively, the pixel may be taken to a high potential (rail voltage) and then discharged, through precision control, to a select potential. The background grid can be biased to any of a range of potentials, both positive and negative as well as ground.

Consequently, a highly-controllable external E-field gradient is established between the pixel plates of the image plate and the co-located developer, e.g., a conductive transfer device or development plate. In this case, the developer and imaging plate form essentially a parallel plate capacitor arrangement. The resulting electrostatic field is used to move toner particles from the developer to the imaging plate.

The individual pixel areas may be optimally shaped and arranged depending upon the end application or embodiment. This includes circular, oval, triangular, square, rectangular and other pixel geometries and topologies. Furthermore, these pixels may be arranged in even pitched arrangement or be interleaved to minimize the open space between pixels. Again, depending upon the end embodiment or application space, the geometry and pixel layout can be tailored for specific scenarios.

As shown in FIG. 2, a charged developer (201) is covered with charged toner particles (102) for developing a latent image. As before, the developer (201) may be a roller or a plate as best serves a particular application. The developer (201) is connected to a ground plate (110) through a direct current voltage source (214) and a voltage oscillator (213). The toner particles (102) may be the same toner particles used in the DAD printing system of FIG. 1 and are negatively charged. Unlike the DAD printing system, the developer (201) of FIG. 2 is operated with a positive bias during printing.

The imaging plate (200) again includes a wear layer (104) and an insulator or insulating layer (107) that is disposed between the wear layer (104) and base substrate (108). The thickness of the wear layer may be, for example, 0.5 μm up to 7.0 μm. A wear layer of approximately 0.5 μm produces high normal E-fields at a constant developer bias level, but has variation in the E-fields between near neighboring pixels. Consequently, pixel to pixel toner development uniformity can be fine tuned by the proper selection of wear layer thickness. Thicker wear layers will also be accompanied by increases in the DC developer voltage to compensate for the additional dielectric thickness. There are some additional tradeoffs when altering wear layer parameters. Solid area uniformity improves with thicker rather than thinner wear layers, but single pixel E-field profiles will have flatter, more narrow tops with wider bottoms.

Within the insulator (107), an array of pixel plates (105) are provided. As before, each pixel plate (105) is located parallel to and just below the wear layer (104) of the imaging plate (200). As shown in FIG. 2, each pixel plate (105) is electrically connected through the imaging plate (200) to one of a corresponding array of voltage generators (211). As will be described in more detail below, this conductive plate of each pixel (105) can be selectively given a positive electrical bias so as to electrostatically move toner (102) from the developer (201) to the imaging plate (100) to print a pixel corresponding to the charged pixel plate (105). The positive bias on a pixel plate (105) receiving toner (102) will be higher than the positive bias on the developer (201) so as to release toner particles (102) from the developer (201) and move them to the activated pixel plates (105).

Each pixel plate (105) is connected to a corresponding voltage generator (211) through a switch (112). The switch (112) can selectively connect the corresponding pixel plate (105) to either the voltage generator (211) or the ground plate (110). When an image is to be printed, the developer (201) is loaded with toner (102). Additionally, a latent image is formed on the imaging plate (100). This is done by selectively connected pixel plates (105) with corresponding voltage generators (211) in a pattern that forms the desired latent image on the imaging plate (200). Pixel plates (105) that are to receive toner are connected to a respective voltage generator (211) and given a positive bias greater than that of the developer (201). Pixel plates (105) that are not to receive toner (102) are grounded, with respective switches (112) connecting those pixel plates (105) to the ground plate (110).

In order to prevent toner particles (102) from being deposited between pixel plates (105), a background grid (206) is again provided in the imaging plate (200) between pixel plates (105). In the embodiment shown in FIG. 2, the background grid (206) is located in the insulating layer (107) in the same plane as the pixel plates (105). Consequently, the background grid (206) is, in this case, referred to as a co-planar grid.

The background grid (206) is also electrically connected to a switch (220). The switch (220) selectively connects the background grid (206) to the ground plate (110) or to a voltage generator (209). The voltage generator (209) can produce both positive and negative biases for the background grid (206). Consequently, a broad range of control is provided over the electrical fields created between the developer (201) and the imaging plate (200).

Thus, when an image is to be printed, the developer (101) is loaded with toner (102) and a latent image is formed on the imaging plate (200). The latent image is formed by pixel plates (105) that are connected through respective switches (112) to voltage generators (211) and, therefore, given a positive bias. Pixel plates (105) that do not form part of the latent image are connected through respective switches (112) to the ground plate (110). The developer (201) may then be passed over or brought near the imaging plate (200) depending on the particular mechanism employed. The negatively-charged toner particles (102) on the developer (201) are attracted to the positively-biased pixel plates of the latent image to develop the latent image. Toner particles (102) are not deposited on the unbiased pixel plates that are not part of the latent image.

The background grid (206) can be given any of a range of biases by the generator (209). For example, a negative bias on the background grid (206) repels the negatively charged toner particles (102) to prevent them from being deposited in the areas between pixel plates (105). In some instances the background grid (206) may have a neutral bias so that there is not voltage gradient between the background grid (206) and all the grounded or deactivated pixel plates (105).

Because of the relatively strong positive bias on the activated pixel plates (105) of the latent image, toner particles (102) are moved electrostatically by the resulting electrical field (203) from the developer (201) to the areas of the imaging plate (200) that correspond to each positively biased pixel plate (105). In this way, toner particles (102) are selectively deposited on the imaging plate (201) only over the selected pixel plates (105) of the latent image. The developed image can then be transferred to a sheet of print media, such as paper, and the printing process for that image is complete.

The CAD technique described herein provides enhanced control of the electrical field generated between the developer and the imaging plate. This can produce enhanced print quality by, for example, enhancing the edge acuity of printed images. This provides improved visual acuity and vernier acuity in the printed image and may render printed text, for example, easier to read. The CAD technique also eliminates any difficulties that might occur with controlling contrast electrical fields between the background and the pixel image during the development process. The CAD technique eliminates the need for reverse biasing of the background grid required by the DAD method described above. In other words, it is possible to create a positive field that attracts toner or to use electrostatics to push particles towards the counter-electrode. The Charge Area Development techniques do not require the ground bias plane as the potential of this plane relative to the counter electrode does not affect the fields.

CAD provides a greater range of electrostatic control over the E-field space above the biased pixels by allowing the application of different levels of electrical bias and polarities as between the pixel plates (105) and background grid (206). The DAD method has limited control and can only adjust the pixel and sub-planar grid bias levels to achieve desired results. Unlike the DAD method, described above, the CAD technique eliminates the need for balancing the E-fields above the background and pixel areas when operating in a no-print condition. When pixels are off in the CAD embodiment, there is no voltage gradient between the background and the pixel. Consequently, E-field balancing is not required.

Figure 3:
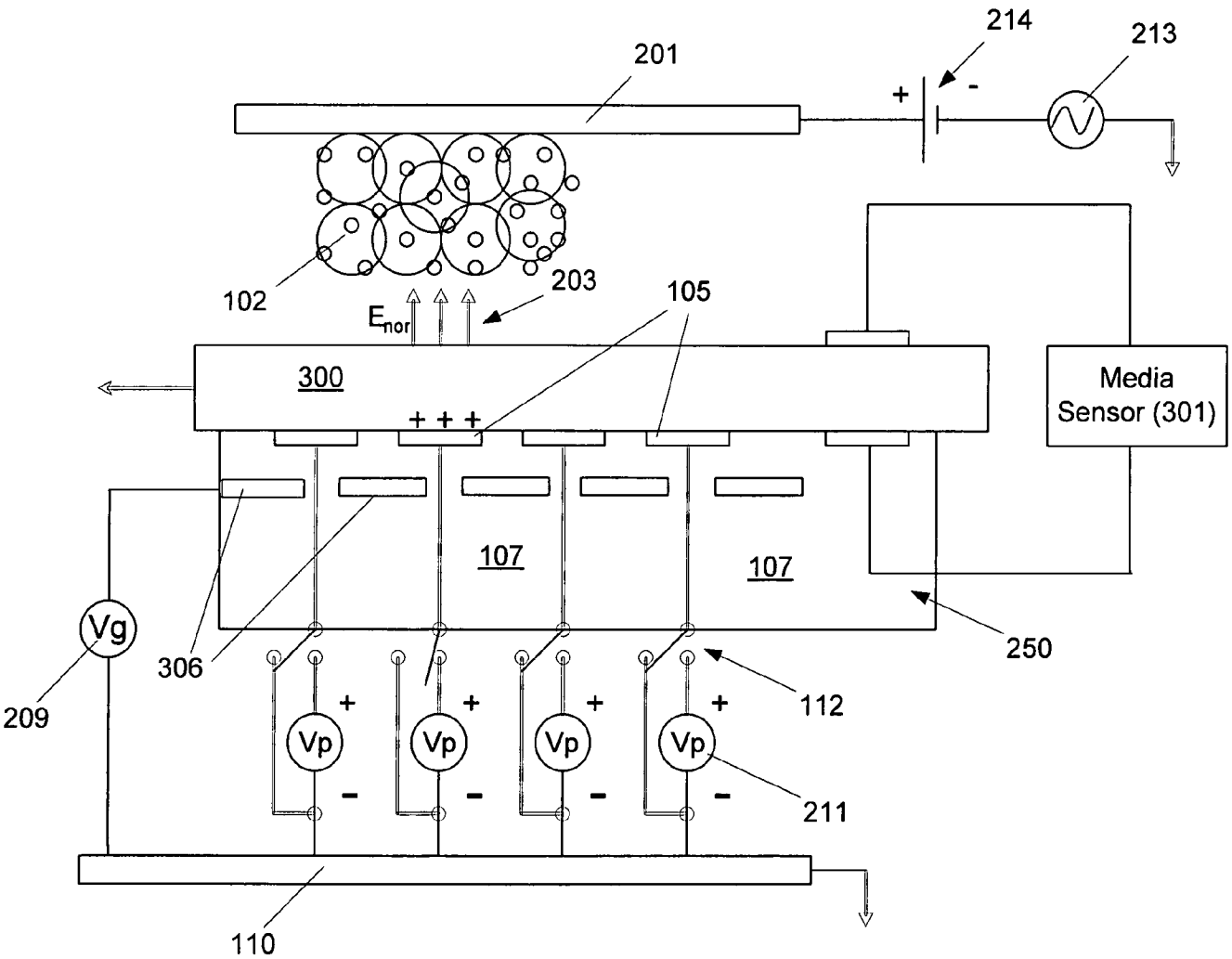
FIG. 3 illustrates another example of a printing device that uses an electrical field to selectively transfer charged toner particles from a developer to develop a latent image formed on an imaging plate according to principles described herein.

FIG. 3 illustrates another example of a printing device that uses an electrical field to selectively transfer charged toner particles from a developer to develop a latent image formed on an imaging plate according to principles of Charge Area Development (CAD) described herein. Many of the components of the device of FIG. 3 have already been described in connection with FIG. 2. Consequently, a redundant explanation will be avoided.

In the example shown in FIG. 3, the device develops the latent image or prints the developed image directly on a sheet of print media, such as paper, rather than developing the latent image on the imaging plate. As will be appreciated by those skilled in the art, the term "print media" or "print medium" as used herein and in the appended claims refers broadly to any media on which a printing device renders a hardcopy image. Consequently, "print media" or "print medium" may refer, but is not limited to, paper, cardstock, envelopes, cardboard, vinyl, transparencies, construction paper, etc.

As shown in FIG. 3, a latent image is formed as described above. The latent image is formed by pixel plates (105) that are connected through respective switches (112) to voltage generators (211) and, therefore, given a positive bias. Pixel plates (105) that do not form part of the latent image are connected through respective switches (112) to the ground plate (110).

However, in the example of FIG. 3, a sheet of print media (300) is feed across the imaging plate (250). A media feeding system and sensor (301), incorporating for example a capacitive sensor, may be used to detect the presence and/or location of the print medium (300) and to feed sheets of print media onto and across the imaging plate (250). In some embodiments, one of the pixel plates can be used as one plate of the capacitive sensor (301). The use of a single pixel plate as part of a capacitive media sensor will not negatively impact print quality.

The electrical field (203) created between the imaging plate (250) and the developer (201) extends through the print medium (300). Additionally, in the example of FIG. 3, the background grid (306) is sub-planar.

The developer (201) may then be passed over or brought near the print medium (300) on the imaging plate (200) depending on the particular mechanism employed. The negatively-charged toner particles (102) on the developer (201) are attracted to the positively-biased pixel plates of the latent image to develop the latent image. The developed image is formed directly on the print medium (300). Toner particles (102) are not deposited on the print medium (300) over the unbiased pixel plates that are not part of the latent image.

Because of the relatively strong positive bias on the activated pixel plates (105) of the latent image, toner particles (102) are moved electrostatically by the resulting electrical field (203) from the developer (201) to the areas of print medium (300) that overlay positively biased pixel plate (105) of the imaging plate (250). In this way, toner particles (102) are selectively deposited on print medium (300) to develop the latent image. The developed image does not then need to be transferred to a sheet of print media, and the printing process for that image is complete. As will be appreciated by those skilled in the art, any of the examples described herein may be configured to print directly on a sheet of print medium rather than on the imaging plate.

Figure 4:
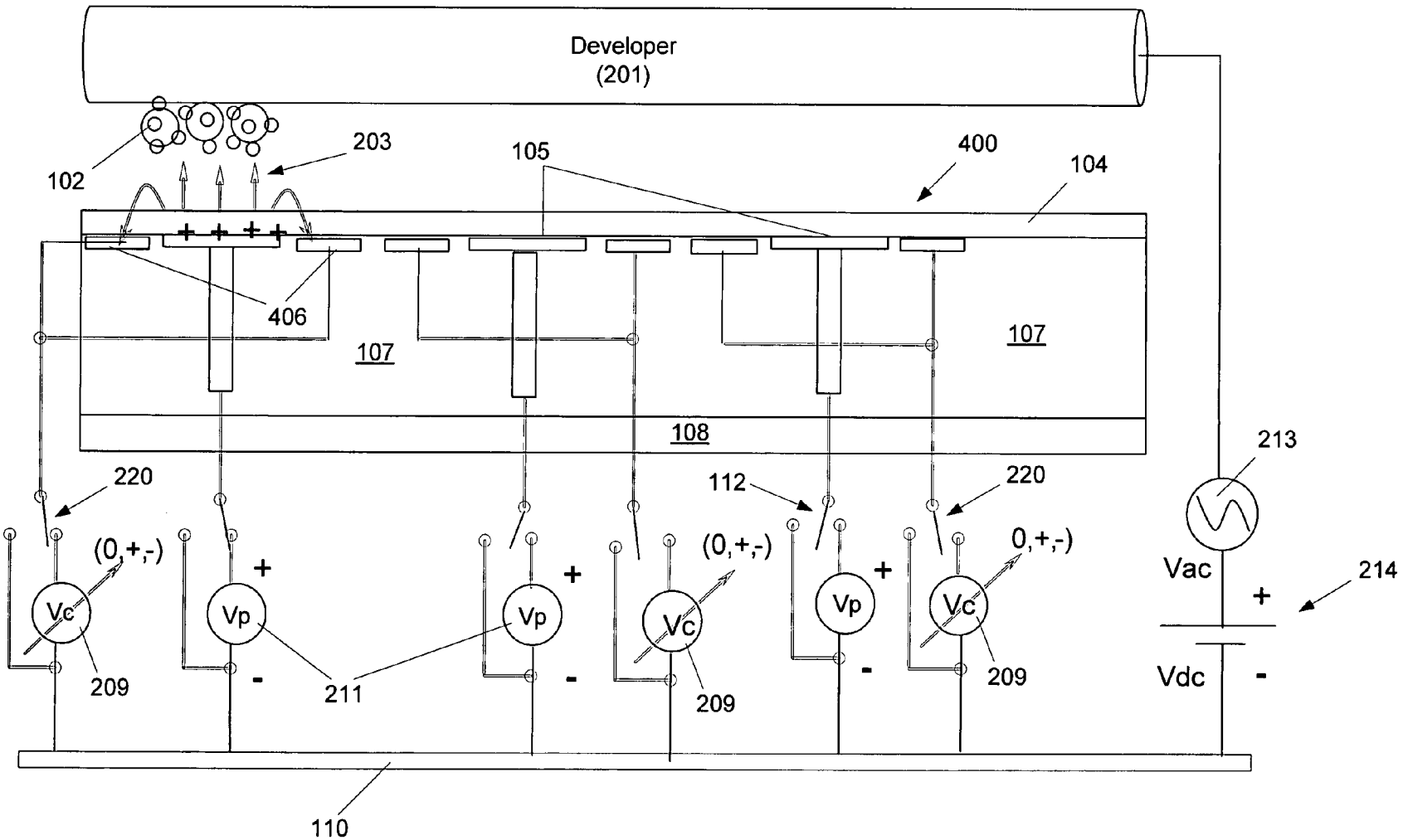
FIG. 4 illustrates another example of a printing device that uses an electrical field to selectively transfer charged toner particles from a developer to develop a latent image formed on an imaging plate according to principles described herein.

FIG. 4 illustrates another example of a printing device that uses an electrical field to selectively transfer charged toner particles from a developer to develop a latent image formed on an imaging plate according to principles of Charge Area Development (CAD) described herein. Many of the components of the device of FIG. 4 have already been described in connection with FIG. 2. Consequently, a redundant explanation will be avoided.

As shown in FIG. 4, the charged developer (201) is covered with charged toner particles (102) for developing a latent image. The developer (201) is connected to a ground plate (110) through a direct current voltage source (214) and a voltage oscillator (213). As above, the developer (201) of FIG. 4 is operated with a positive bias during printing.

The imaging plate (400) again includes a wear layer (104) and an insulator or insulating layer (107) that is disposed between the wear layer (104) and base substrate (108). Within the insulator (107), an array of pixel plates (105) are provided, where each pixel plate (105) is located parallel to and just below the wear layer (104) of the imaging plate (400). As shown in FIG. 2, each pixel plate (105) is electrically connected through the imaging plate (400) to one of a corresponding array of voltage generators (211). Consequently, the conductive plate of each pixel (105) can be selectively given a positive electrical bias so as to electrostatically move toner (102) from the developer (201) to the imaging plate (100). Each pixel plate (105) is connected to the corresponding voltage generator (211) through a switch (112). The switch (112) can selectively connect the corresponding pixel plate (105) to either the voltage generator (211) or the ground plate (110).

When an image is to be printed, the developer (201) is loaded with toner (102). Additionally, a latent image is formed on the imaging plate (100). This is done by selectively connected pixel plates (105) with corresponding voltage generators (211) in a pattern that forms the desired latent image on the imaging plate (400). Pixel plates (105) that are to receive toner are connected to a respective voltage generator (211) and given a positive bias greater than that of the developer (201). Pixel plates (105) that are not to receive toner (102) are grounded, with respective switches (112) connecting those pixel plates (105) to the ground plate (110).

In order to prevent toner particles (102) from being deposited between pixel plates (105), a background grid (406) is again provided in the imaging plate (400) between pixel plates (105). In the embodiment shown in FIG. 4, the background grid (206) co-planar with the pixel plates (105). Additionally, the background grid (406) is formed a number of corbino rings, a ring surrounding each pixel plate (105).

Each corbino ring (406) is connected through the imaging plate (400) to a voltage generator (209). Each corbino ring (406) is connected to the corresponding voltage generator (209) through a switch (220). Each switch (220) selectively connects the individual corbino ring (406) of the background grid to the ground plate (110) or to the corresponding voltage generator (209). Each voltage generator (209) can produce both positive and negative biases for the corresponding corbino ring (406). Consequently, a broad range of control is provided over the electrical fields created between the developer (201) and each pixel plate (105) of the imaging plate (400).

When an image is to be printed, the developer (101) is loaded with toner (102) and a latent image is formed on the imaging plate (400). The latent image is formed by pixel plates (105) that are connected through respective switches (112) to voltage generators (211) and, therefore, given a positive bias. Pixel plates (105) that do not form part of the latent image are connected through respective switches (112) to the ground plate (110). The developer (201) may then be passed over or brought near the imaging plate (400) depending on the particular mechanism employed. The negatively-charged toner particles (102) on the developer (201) are attracted to the positively-biased pixel plates of the latent image to develop the latent image. Toner particles (102) are not deposited on the unbiased pixel plates that are not part of the latent image.

Because of the relatively strong positive bias on the activated pixel plates (105) of the latent image, toner particles (102) are moved electrostatically by the resulting electrical field (203) from the developer (201) to the areas of the imaging plate (400) that correspond to each positively biased pixel plate (105). In this way, toner particles (102) are selectively deposited on the imaging plate (400) only over the selected pixel plates (105) of the latent image. The developed image can then be transferred to a sheet of print media, such as paper, and the printing process for that image is complete.

Figure 5:
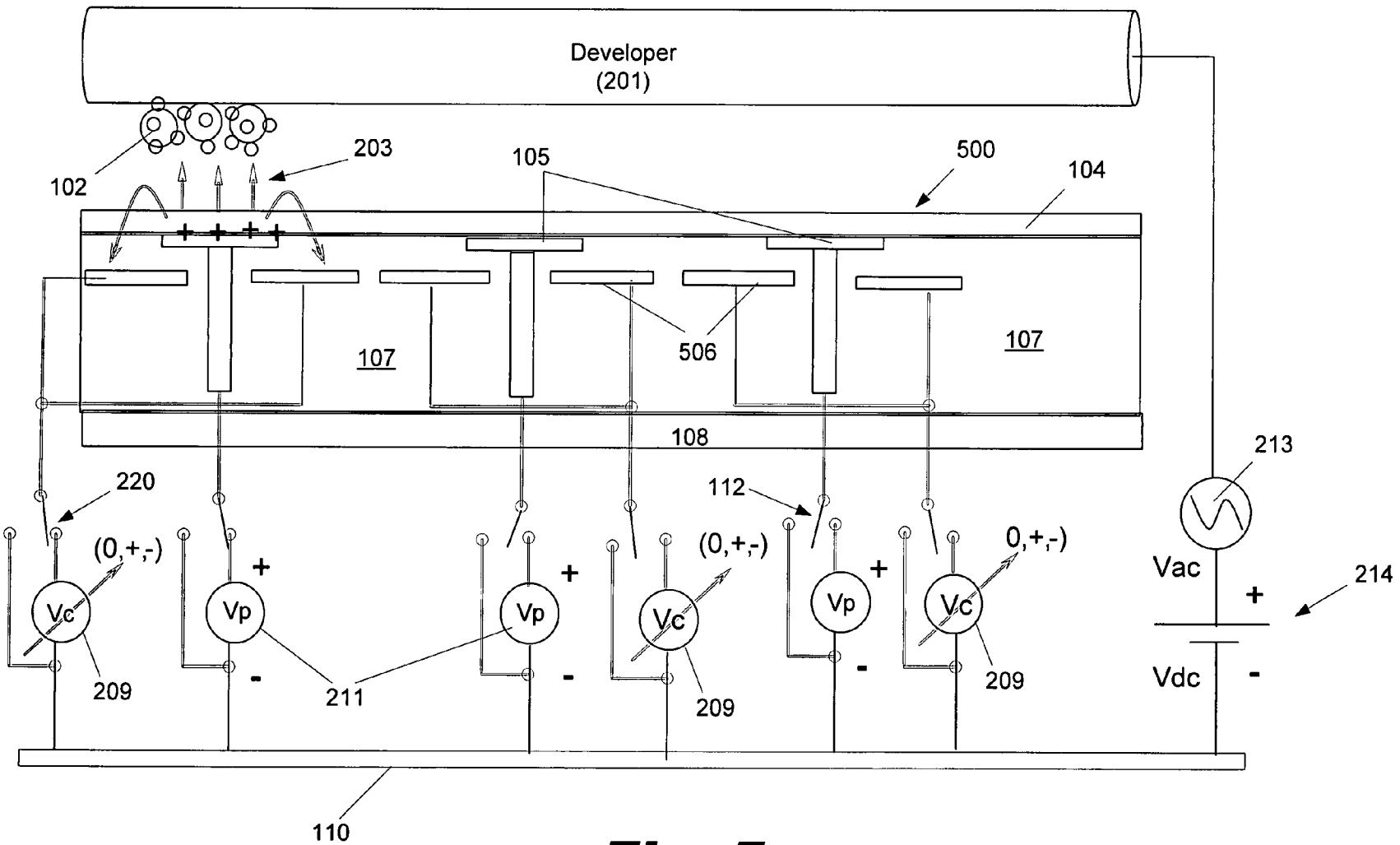
FIG. 5 illustrates another example of a printing device that uses an electrical field to selectively transfer charged toner particles from a developer to develop a latent image formed on an imaging plate according to principles described herein.

FIG. 5 illustrates another example of a printing device that uses an electrical field to selectively transfer charged toner particles from a developer to develop a latent image formed on an imaging plate according to principles of Charge Area Development (CAD) described herein. Many of the components of the device of FIG. 5 have already been described in connection with FIG. 4. Consequently, a redundant explanation will be avoided.

As shown in FIG. 5, the background grid is again formed as a number of corbino rings (506), each corbino ring (506) corresponding to a particular pixel plate (105) and being connected to a corresponding voltage generator (209) with which the bias of that corbino ring (506) can be individually controlled. As always shown in FIG. 5, the corbino rings (506) can be located sub-planar to the pixel plates (105), meaning that the corbino rings (506), that compose the background grid in this example, are buried in the insulating layer (107) of the imaging plate (500) and are thus below and spaced from the plane of the pixel plates (105).

Figure 6:
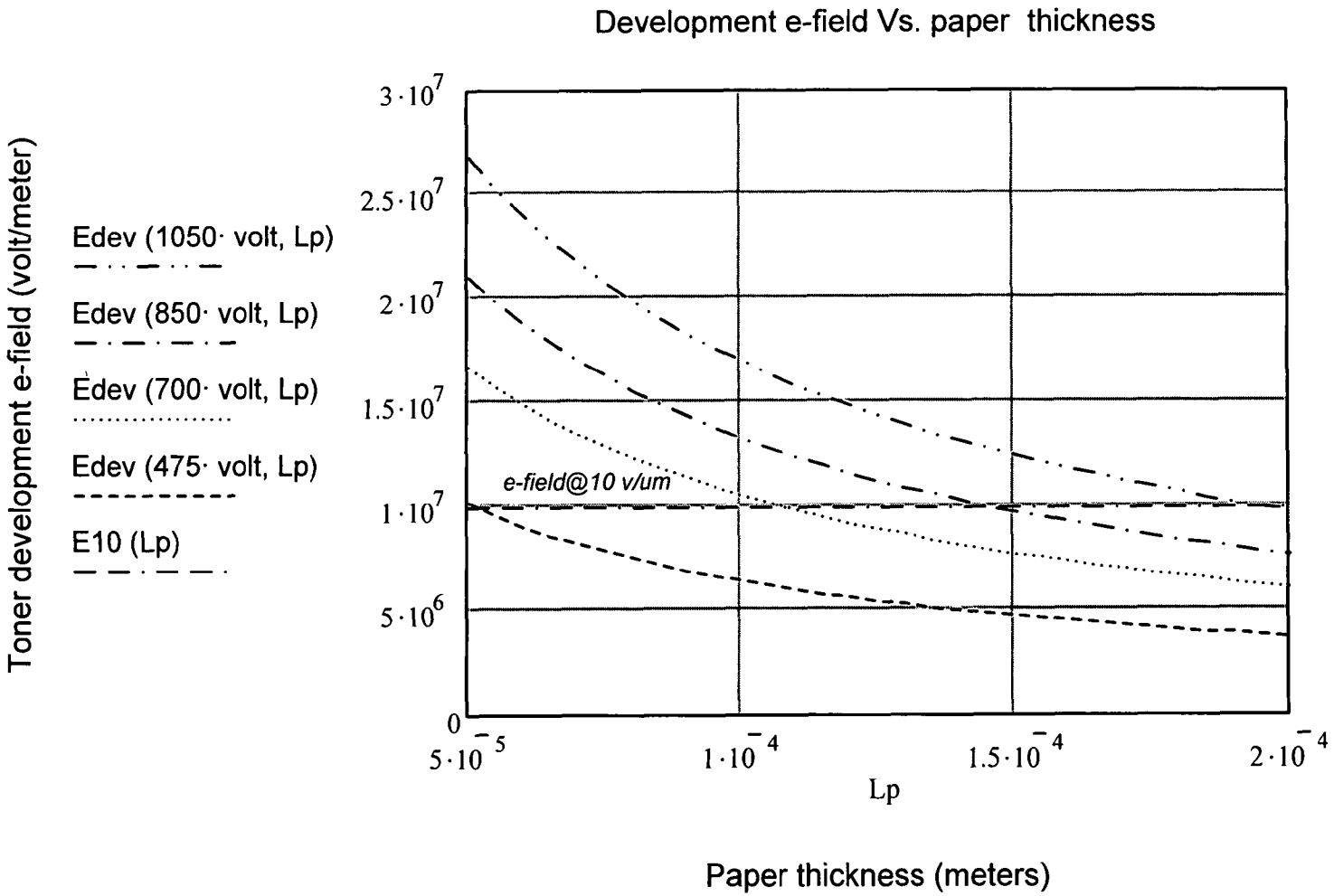
FIGS. 6 and 7 are graphs showing the relationship between developed E-field and paper thickness.
Figure 7:
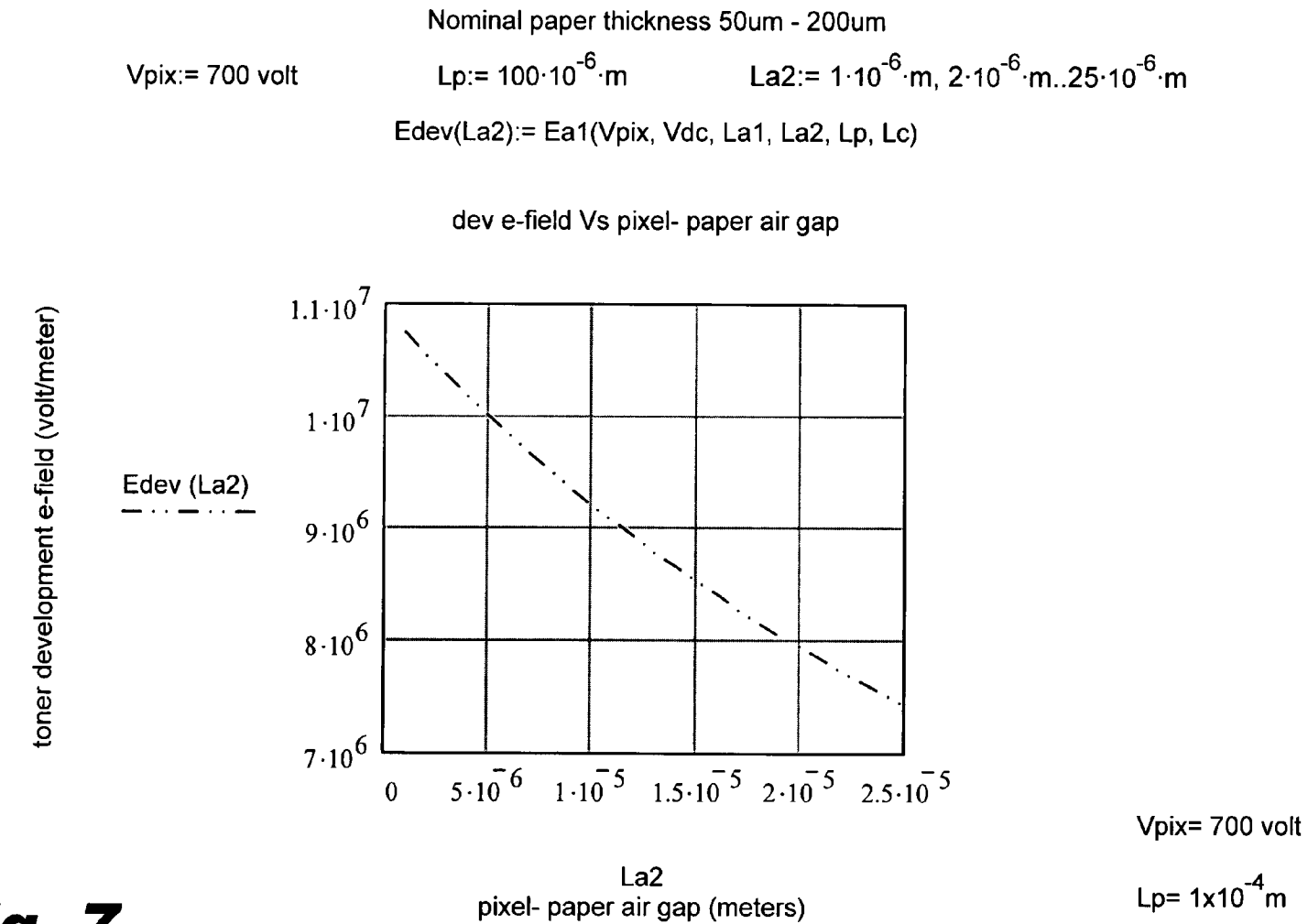

FIGS. 6 and 7 are graphs showing the relationship between developed E-field and paper thickness. This relationship is relevant in, for example, the device shown in FIG. 3 that prints directly on the print medium.

The preceding description has been presented only to illustrate and describe embodiments of the invention. It is not intended to be exhaustive or to limit the invention to any precise form disclosed. Many modifications and variations are possible in light of the above teaching.

What is claimed is:

1. A printing device comprising:

a developer for developing a latent image with toner particles;

an imaging plate comprising a plurality of pixel plates; and a plurality of voltage generators connected respectively to said pixel plates;

wherein said voltage generators bias selected pixel plates to form a latent image that is developed with toner from said developer.

2. The device of claim 1, further comprising a voltage generator for biasing said developer to attract oppositely charged toner particles, wherein said voltage generators connected respectively to said pixel plates selectively bias said pixel plates to attract said oppositely charged toner particles, said pixel plates, when selectively biased, being biased more strongly than said developer.

3. The device of claim 1, further comprising a background grid in said imaging plate for preventing toner particles from being deposited in areas between said pixel plates.

4. The device of claim 3, wherein said background grid is connected to a voltage generator for applying a range of biases, positive and negative to said background grid.

5. The device of claim 4, further comprising a ground plate and a switch connected between said background grid and said voltage generator of said background grid such that, by operation of said switch, said background grid can be selectively connected either to a said voltage generator or said ground plate.

6. The device of claim 3, wherein said background grid is co-planar with said pixel plates.

7. The device of claim 3, wherein said background grid is sub-planar with respect to said pixel plates and located in an insulating layer of said imaging plate.

8. The device of claim 3, wherein said background grid comprises corbino rings.

9. The device of claim 8, wherein each said corbino ring is connected to a respective voltage generator for applying a range of biases, positive and negative to said respective corbino ring.

10. The device of claim 1, further comprising a media sensor and feeding device for feeding print media onto said imaging plate, wherein said developer develops said latent image directly on said print media.

11. The device of claim 10, wherein said media sensor is a capacitive sensor that includes a pixel plate of said imaging plate.

12. The device of claim 1, further comprising a ground plate and a plurality of switches connected between respective pixel plates and voltage generator such that, by operation of a said switch, each pixel plate can be selectively connected either to a said voltage generator or said ground plate.

13. A printing device comprising:

a developer for developing a latent image with toner particles;

an imaging plate comprising a plurality of pixel plates for selectively receiving toner particles from said developer;

a plurality of voltage generators for biasing respective to pixel plates; and a background grid in said imaging plate for preventing toner particles from being deposited in areas between said pixel plates, wherein said background grid is connected to a voltage generator for applying a range of biases, positive and negative to said background grid.

14. The device of claim 13, wherein said voltage generators connected to said pixel plates positively bias selected pixel plates to form a latent image that is developed with toner from said developer.

15. The device of claim 13, further comprising a voltage generator for positively biasing said developer.

16. The device of claim 13, further comprising a ground plate and a switch connected between said background grid and said voltage generator of said background grid such that, by operation of said switch, said background grid can be selectively connected either to a said voltage generator or said ground plate.

17. The device of claim 13, wherein said background grid is co-planar with said pixel plates.

18. The device of claim 13, wherein said background grid is sub-planar with respect to said pixel plates and located in an insulating layer of said imaging plate.

19. The device of claim 13, wherein said background grid comprises corbino rings.

20. The device of claim 19, wherein each said corbino ring is connected to a respective voltage generator for applying a range of biases, positive and negative to said respective corbino ring.

21. The device of claim 19, further comprising a media sensor and feeding device for feeding print media onto said imaging plate, wherein said developer develops said latent image directly on said print media.

22. A method of electrophotographic printing in which toner particles are moved electrostatically from a developer biased to attract oppositely charged toner particles to develop a latent image, said method comprising:

biasing selected pixel plates of a plurality of pixel plates of an imaging plate to form said latent image, wherein said selected pixel plates are biased to attract oppositely charged toner particles, and said pixel plates, when selectively biased, are biased more strongly than said developer; and developing said latent image with said toner particles from said developer.

23. The method of claim 22, further comprising positively biasing said developer.

24. The method of claim 22, further comprising preventing toner particles from being deposited in areas between said pixel plates with a background grid in said imaging plate.

25. The method of claim 24, wherein said background grid is connected to a voltage generator for applying a range of biases, positive and negative to said background grid.

26. The method of claim 24, wherein said background grid comprises corbino rings.

27. The method of claim 22, further comprising feeding print media onto said imaging plate, wherein said developer develops said latent image directly on said print media.

28. A system for electrophotographic printing in which toner particles are moved electrostatically from a developer biased to attract oppositely charged toner particles to develop a latent image, said system comprising:

means for biasing selected pixel plates of a plurality of pixel plates of an imaging plate to form said latent image, wherein said selected pixel plates are biased to attract oppositely charged toner particles, and said pixel plates, when selectively biased, are biased more strongly than said developer; and means for developing said latent image with said toner particles from said developer.

* * * * *